US007552557B1

(12) United States Patent
Mabry

(10) Patent No.: US 7,552,557 B1
(45) Date of Patent: Jun. 30, 2009

(54) PIVOTABLE SHOULDER STOCK AND HANDGUN COMBINATION

(76) Inventor: James B. Mabry, 1932 Gerringer Mill Rd., Burlington, NC (US) 27217

( * ) Notice: Subject to any disclaimer, the term of this patent is extended or adjusted under 35 U.S.C. 154(b) by 0 days.

(21) Appl. No.: 12/152,767

(22) Filed: May 16, 2008

(51) Int. Cl.
*F41C 23/00* (2006.01)

(52) U.S. Cl. ..... 42/72; 42/71.01; 42/71.02; 42/73

(58) Field of Classification Search ..... 42/71.01, 42/71.02, 72, 73
See application file for complete search history.

(56) References Cited

U.S. PATENT DOCUMENTS

| | | | | |
|---|---|---|---|---|
| 3,052,053 | A | 9/1962 | Vartanian | |
| 3,262,440 | A | 7/1966 | Kuhn | 124/67 |
| 3,369,316 | A * | 2/1968 | Arthur | 42/72 |
| 3,388,494 | A | 6/1968 | Kimball | 42/74 |
| 3,526,972 | A * | 9/1970 | Sumpf | 434/22 |
| 3,685,828 | A | 8/1972 | Getgey et al. | 273/356 |
| 4,559,737 | A | 12/1985 | Washington | 43/59 |
| 5,225,613 | A | 7/1993 | Claridge | 42/74 |
| 5,351,428 | A | 10/1994 | Graham | 42/72 |
| 6,276,085 | B1 | 8/2001 | Wooten et al. | 42/1.08 |
| 6,543,173 | B1 | 4/2003 | Golan | 42/75.04 |
| 6,560,911 | B2 | 5/2003 | Sharp | 42/73 |
| 6,805,111 | B2 | 10/2004 | Tippmann, Jr. | 124/74 |
| 6,901,691 | B1 | 6/2005 | Little | 42/118 |
| 7,024,812 | B2 | 4/2006 | Nelson | 42/73 |
| 7,225,576 | B2 | 6/2007 | Ballard | 42/118 |
| 2001/0015090 | A1 * | 8/2001 | Kolbe | 73/35.01 |

OTHER PUBLICATIONS

U.S. Appl. No. 11/589,538, filed Oct. 30, 2006, Marby, James B.
Six (6) page printout from the website, www.israeli-weapons.com, showing the "Corner Shot"; undated.

* cited by examiner

*Primary Examiner*—J. Woodrow Eldred
*Assistant Examiner*—Gabriel J Klein

(57) ABSTRACT

A pivotable shoulder stock for use in combination with a handgun includes a mirror and allows the user to aim and fire an equipped laser handgun around the corner of a building or other obstacle. The user is able to fire with relative accuracy from behind a building or other obstacle using the mirror attached to the shoulder stock. The mirror can be adjustably positioned for viewing in order to fire the handgun at about a ninety degree (90°) angle in either a clockwise or counter-clockwise direction. The mirror can be revolved to a downward posture when firing the handgun in a linear direction similar to a rifle or for storage purposes. The pivotable shoulder stock is relatively simple to operate and can be quickly adjusted by latching the second section against the first section for use as a hand weapon rather than being shoulder fired.

6 Claims, 7 Drawing Sheets

PIVOTABLE SHOULDER STOCK AND HANDGUN COMBINATION

FIELD OF THE INVENTION

The invention herein pertains to a shoulder stock for mounting a handgun and particularly pertains to a pivotable shoulder stock to permit selective rotation of the handgun with a laser attached for use in aiming and firing the handgun around the corner of a building or other structure.

DESCRIPTION OF THE PRIOR ART AND OBJECTIVES OF THE INVENTION

Policemen and other law enforcement personnel often encounter violent offenders which carry pistols, rifles and other weapons. In addition, military operations often occur in urban areas requiring soldiers to patrol towns and cities. During patrol police and military personnel must often take cover behind cars, houses, buildings and the like and fire their weapons at close range around such structures which often obliterate a clear, linear view of the target. In such instances it is advantageous to have a weapon which will allow visible ninety degree (90°) firings, that is, the ability to fire a weapon accurately around the corner of a building or other obstacle without exposure as explained in my earlier patent application Ser. No. 11/589,538 filed 30 Oct. 2006, now U.S. Pat. No. 7,437,847. One weapon of choice is a pistol mount in the form of a shoulder stock having an attached mirror. Such a device is the Israeli Corner Shot™ which utilizes a color video monitor, folding stock and various other accessories. Due to the many high-tech electronic components employed, the price of the Israeli Corner Shot™ is often unaffordable for many small police departments. Repair and service can also make the Israeli Corner Shot™ impractical. Thus, based on the needs and budgets of law enforcement departments, the present invention was conceived and one of its objectives is to provide a pivotable shoulder stock for a standard handgun having a laser aiming device.

It is another objective of the present invention to provide a pivotable shoulder stock which can be easily assembled, adjusted and repaired on site as needed.

It is still another objective of the present invention to provide a pivotable shoulder stock for a handgun which allows the user to make corner shots quickly and accurately by using the attached mirror.

It is yet another objective of the present invention to provide a pivotable shoulder stock for a handgun which can be adjusted to any of a variety of angular positions, depending on the particular situation at hand.

It is yet a further objective of the present invention to provide a pivotable shoulder stock for a handgun which is relatively inexpensive to manufacture, sell and service and which is lightweight for convenient manual carrying.

Various other objectives and advantages of the present invention will become apparent to those skilled in the art as a more detailed description is set forth below.

SUMMARY OF THE INVENTION

The aforesaid and other objectives are realized by providing an adjustable shoulder stock for use with a handgun, such as a 45 caliber automatic pistol as used by U.S. army, various police departments and other agencies. The shoulder stock is comprised of two (2) main sections, a handgun section and a shoulder section. The shoulder stock is foldable and latchable for convenience in transportation and storage. A revolvable mirror is affixed at the intersection of the shoulder section and the handgun section and can be turned for visibility in aiming at different targets by the user. The handgun section and the shoulder section are each formed from a planar metal such as aluminum and are pivotably joined. The handgun section can be pivoted to about either a left or a right ninety degree (90°) position for example when firing the handgun around the corner of a building, such as in urban areas. A spring loaded pin is mounted on the shoulder section and can be raised by manipulation of locking pin linkage to allow the handgun section to pivot as desired. The pin is then lowered as the linkage is released to lock the handgun section at a particular angle relative to the shoulder section. A brace which includes a handle is releasably affixed to the shoulder section proximate the handgun section. The brace is provided to stabilize the shoulder stock for shooting accuracy, for example when the handgun section is positioned at ninety degrees (90°). A stock handle is affixed to the shoulder section proximate the stock trigger for additional stability when aiming and firing.

In order to fire the handgun which is attached to the handgun section, a trigger mechanism is provided. The trigger mechanism includes a stock trigger, a trigger spring, a first rod, a circular crank comprising a series of posts and apertures, a magnetic connector, a second rod and a trigger lever. A stock trigger is pivotably mounted to the shoulder section and includes an aperture for receiving one end of the first rod. A trigger spring is positioned at the proximate end of the first rod and the opposite end of the trigger spring is attached to the shoulder section. The distal end of the first rod is received in an aperture provided in the circular crank. A magnetic connector is affixed to the second rod and removably attaches to one of the posts on the circular crank depending on the desired relative position of the handgun section. The second rod extends to a trigger lever pivotably mounted on the handgun section. The circular crank is rotatably positioned at the hinged intersection of the shoulder section and handgun section. The trigger lever is positioned through the trigger guard of the mounted handgun. By pulling the stock trigger for firing purposes, the first rod is pulled causing the crank to rotate thereby pulling the magnetic connector and the second rod which actuates the trigger lever situated proximate the handgun trigger, causing the handgun to discharge. The trigger spring which extended upon pulling the stock trigger then contracts and returns the stock trigger to its normal position after firing.

The shoulder stock can be quickly folded, changed and adjusted during field or combat operations which may include exchanging one handgun for another, changing the angular alignment of the handgun section relative to the shoulder section, or folding the shoulder section which comprises a first section and a second section whereby the second section is foldable against the first section and can be latched thereto to shorten the shoulder stock for firing the handgun off shoulder.

DETAILED DESCRIPTION OF THE PREFERRED EMBODIMENT AND OPERATION OF THE INVENTION

Figure 1:
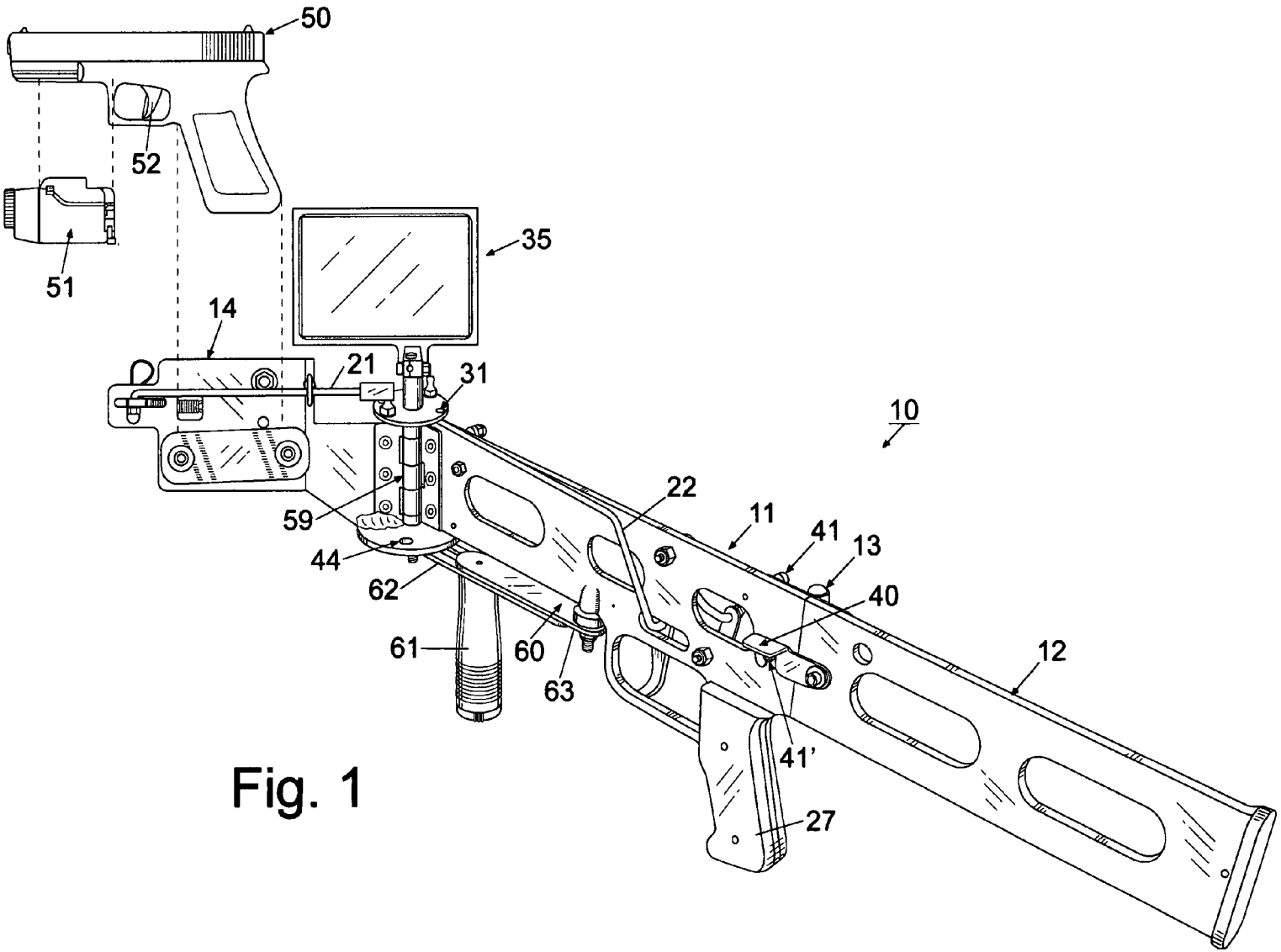
FIG. 1 shows a top, rear, right side perspective view of a pivotable shoulder stock of the invention with the handgun section rotated counterclockwise as viewed downwardly from the front approximately sixty degrees (60°) with the handgun and laser exploded therefrom.
Figure 2:
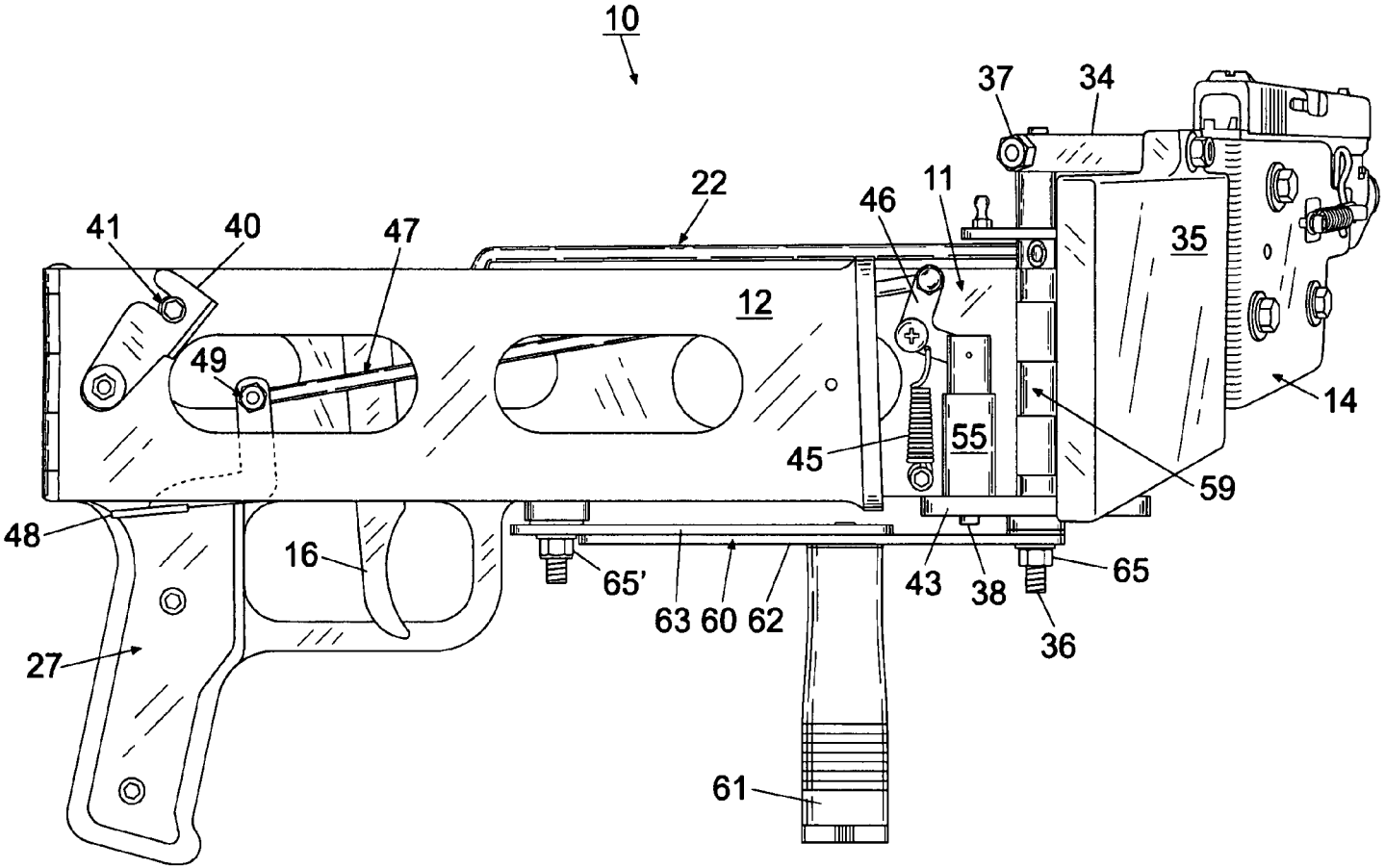
FIG. 2 illustrates the pivotable shoulder stock of FIG. 1 but with the second section folded against the first section, the handgun in place and the handgun section rotated counterclockwise as looking downwardly thereon from the front approximately ninety degrees (90°)
Figure 3:
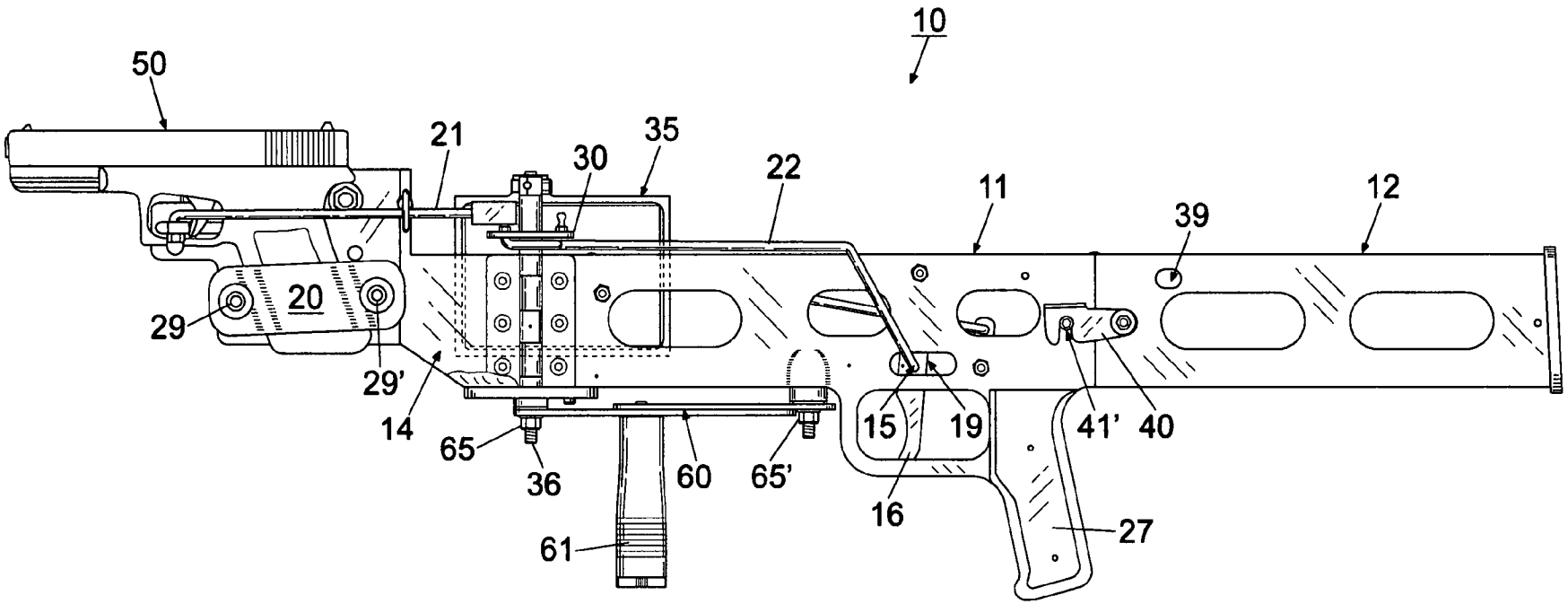
FIG. 3 features a right side elevational view of the pivotable shoulder stock of FIG. 1.

For a better understanding of the invention and its operation, turning now to the drawings, preferred shoulder stock 10 is seen in FIG. 1 having handgun section 14, first shoulder section 11 and second shoulder section 12. Second shoulder section 12 is in linear alignment with and pivotably joined to first shoulder section 11 by attached hinge 13 and is seen locked in place by rotatable latch 40 and latch pins 41, 41'. As seen in FIG. 2, second shoulder section 12 can be pivoted (folded) against first shoulder section 11 and latch 40 rotated to contact latch pin 41 to maintain shoulder stock 10 in a shortened posture. In FIG. 3, second shoulder section 12 is shown unfolded and fully extended whereby latch 40 can be pivoted to contact latch pin 41' to maintain shoulder stock 10 in this extended posture. First shoulder section 11 and second shoulder section 12 are preferably formed from generally planar metal such as aluminum although steel or other suitable composites or polymeric materials could likewise be used. The weight of shoulder stock 10 is reduced by the series of openings shown therein. Second shoulder section 12 includes pin opening 39 (FIG. 3) for receiving latch pin 41 when second shoulder section 12 is folded against first shoulder section 11.

Handgun section 14 is shown in FIG. 1 rotated about hinge 59 at an angle of about sixty degrees (60°) from first shoulder section 11 for aiming and firing for example at targets which are located at about sixty degrees (60°), such as around a building, corner or other obstacle. In order to view the target, mirror 35 is provided and is rotatably positioned atop hinge 59 and rotatably affixed to extension 34. Mirror 35 is vertically rotatable about extension 34 which is horizontally rotatable about hinge 59 allowing mirror 35 to be rotated to a variety of positions. For aiming handgun 50, mirror 35 as illustrated in FIGS. 1 and 2 is manually positioned at different angles as desired depending on the exact alignment of handgun section 14 relative to first shoulder section 11. Second shoulder section 12 may be positioned against the user's shoulder (not shown) during use of a handgun such as handgun 50 shown with laser device 51 in FIG. 1.

Figure 5:
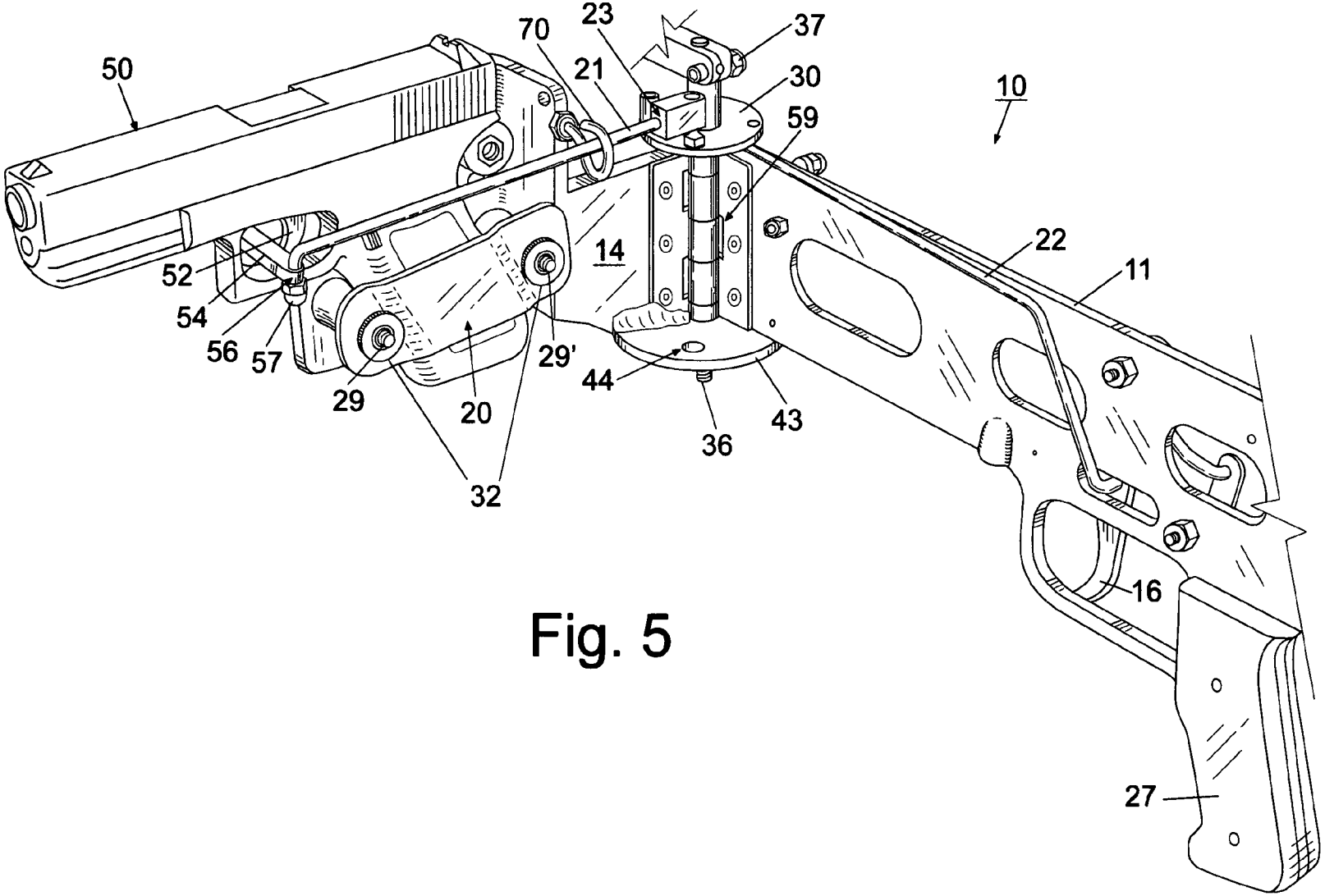
FIG. 5 shows a partial right side elevational view of the pivotable shoulder stock of FIG. 1 with the mirror cut-away.

As shown in FIG. 5, handgun section 14 includes clamping plate 20 which allows a pair of adjustable threaded members 29, 29' received by nuts 32 to retain handgun 50 (45 caliber pistol 50). As an alternative means of retaining handgun 50 to handgun section 14, straps formed from metal or composites may be used as suitable.

Figure 8:
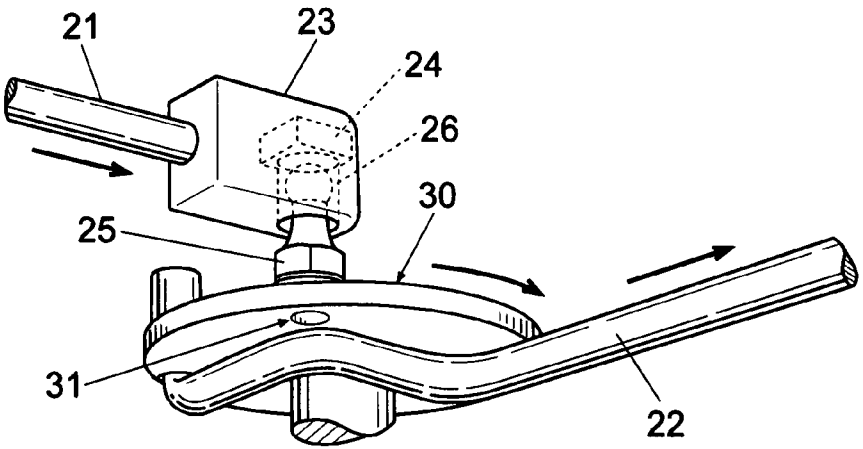
FIG. 8 features an enlarged partial view of the magnetic connector, crank and trigger rod as removed from the pivotable shoulder stock.
Figure 7:
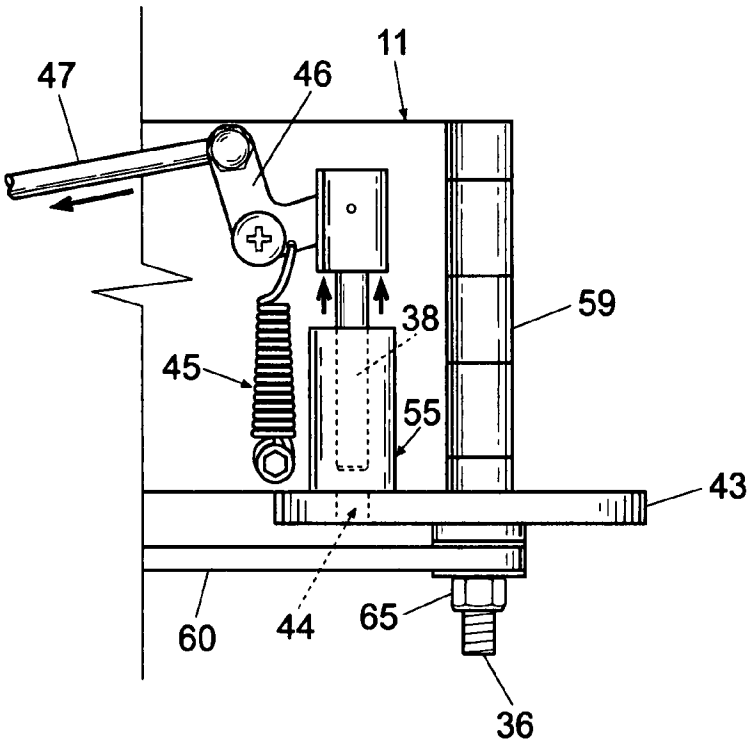
FIG. 7 demonstrates an enlarged cut-away sectional view of the pivotable shoulder stock illustrating the release mechanism.

A fragmented view in FIG. 5 illustrates the pivotable connection of first shoulder section 11 and handgun section 14 with circular crank 30 and disk 43. Crank 30 is shown in FIG. 8 removed and enlarged for clarity to better show the included features. Disk 43, hinge 59 and locking pin 38 are shown in FIG. 7 whereby locking pin 38 is selectively positioned within sleeve 55 on first shoulder section 11 and can be inserted through one of a plurality of pin apertures 44 in disk 43. Disk 43 is rigidly affixed to handgun section 14 such as by welding or the like.

Figure 4:
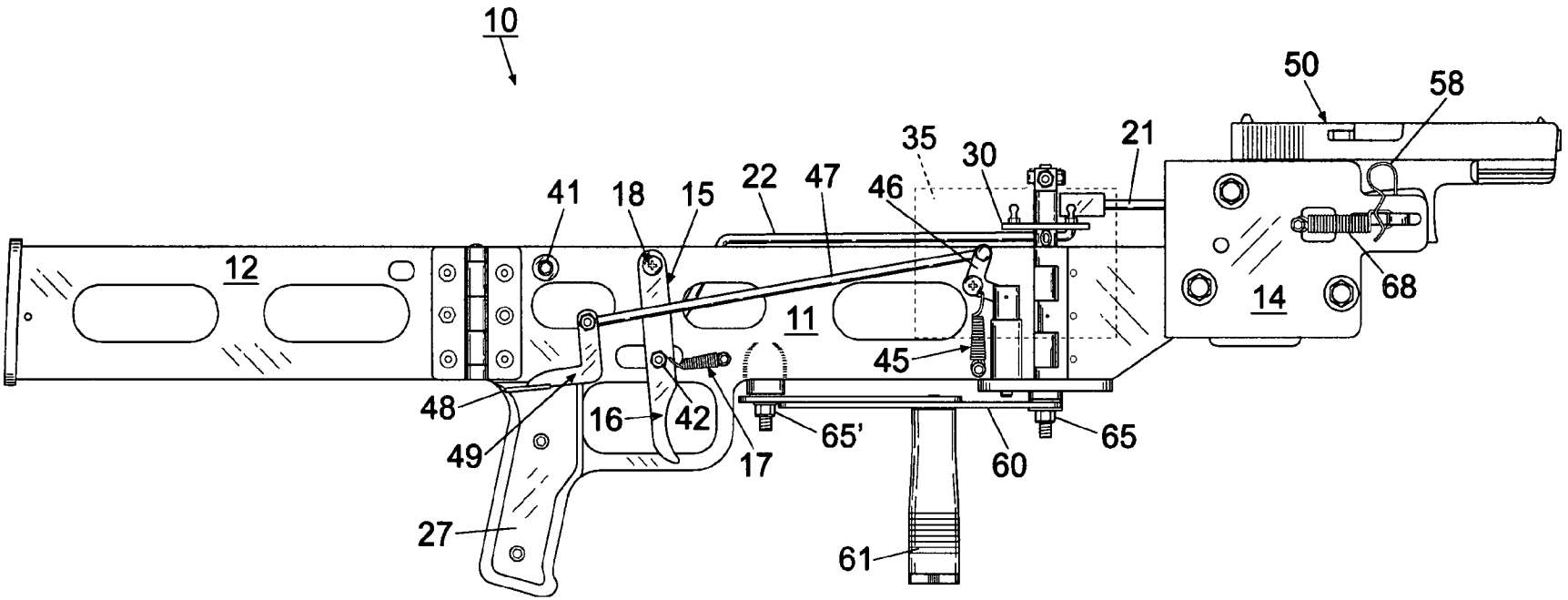
FIG. 4 depicts a left side elevational view of the pivotable shoulder stock as shown in FIG. 3, the mirror shown in dotted configuration.

By manual operation of locking pin linkage 49, which includes finger tab 48, linkage rod 47, L-shaped pin lever 46, coil spring 45 and locking pin 38, as seen in FIGS. 2, 4, 6 and 7, handgun section 14 can be released for pivoting relative to first shoulder section 11. In operation, the user (not shown) depresses finger tab 48 thereby pulling linkage rod 47 causing pin lever 46 to rotate thus extending coil spring 45 and raising and disengaging locking pin 38 from pin aperture 44 in disk 43 as seen in FIG. 7. If finger tab 48 is released coil spring 45 then retracts, returning locking pin linkage 49 so locking pin 38 will engage an available pin aperture 44 in disk 43 to secure the relative position of handgun section 14 and first shoulder section 11. Shoulder stock 10 can also be adjusted to a linear configuration and latched in place by latch 40 and latch pin 41' as seen in FIG. 3 for using handgun 50 like a rifle. In this position mirror 35 is rotated about extension 34 (FIG. 2) to a downward posture as seen in FIGS. 3 and 4 and rods 21, 22 adjusted as required to a proper length on crank 30 for firing purposes. As further shown in FIGS. 3 and 5, mirror 35 is attached to threaded shaft 36 which in turn passes through crank 30, hinge 59, disk 43 and brace 60 and maintained therein by nut 65. As would be understood, by loosening nut 37 mirror 35 is rotatable.

Figure 6:
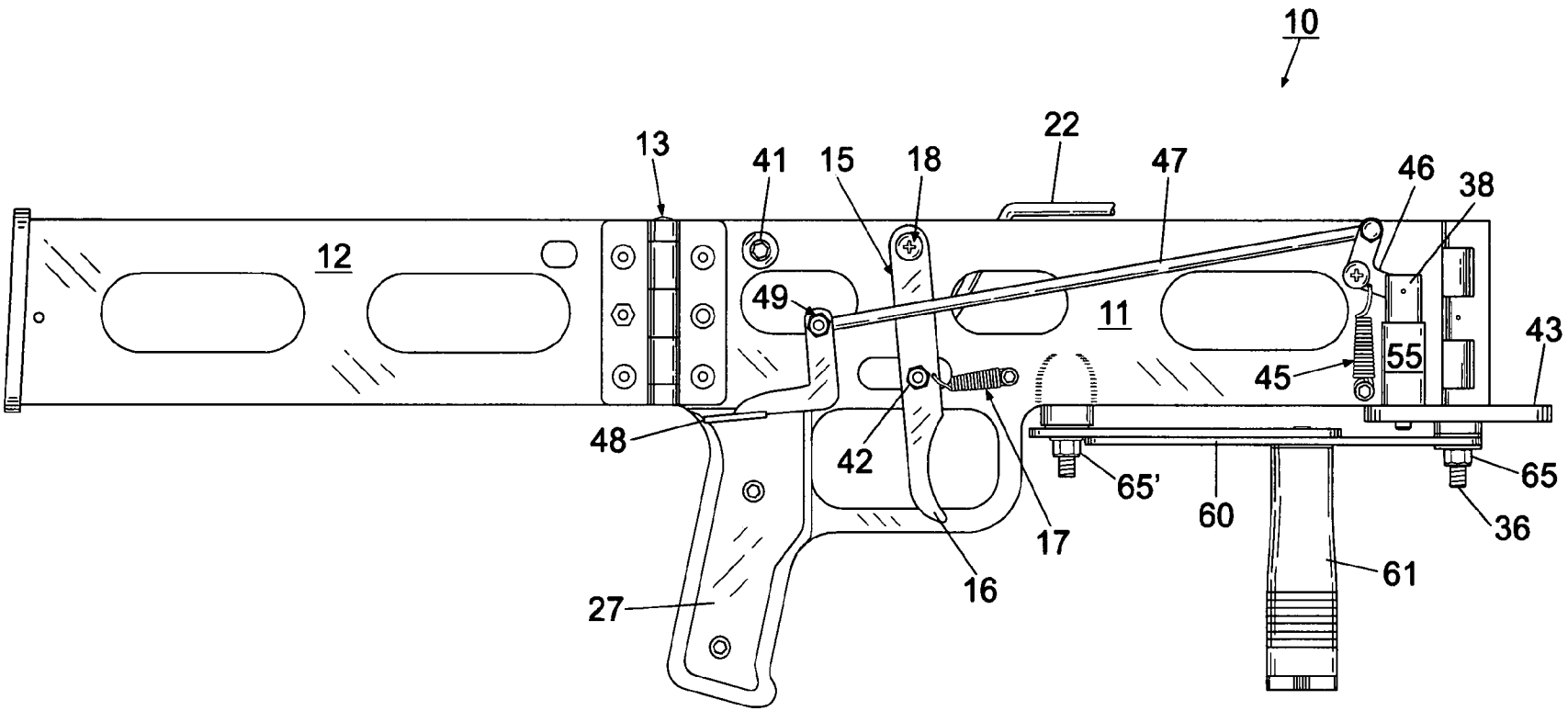
FIG. 6 pictures a partial left side elevational view of the pivotable shoulder stock of FIG. 2.

Trigger mechanism 15 seen in FIGS. 3-8 includes stock trigger 16 pivotably affixed to first shoulder section 11 by trigger axle 18 (FIG. 4). Trigger spring 17 is a conventional coil spring affixed to stock trigger 16 which includes rod opening 19 (FIG. 3) for reception of the proximal end of first rod 22 as shown in FIG. 5. First rod 22 has an L-shaped proximal end which passes through stock trigger 16 and trigger spring 17 and is held therein by conventional nut 42 (FIG. 6). First rod 22 as seen is configured having a bent distal end which passes through one of selected crank apertures 31 in crank 30 as seen in FIGS. 3, 5 and 8. First rod 22 is preferably formed from a rigid steel as is second rod 21 which, as shown in FIG. 8 is connected to magnetic connector 23 having permanent magnet 24 therein. Magnetic connector 23 includes channel 26 for receiving one of posts 25 attached atop crank 30 (FIG. 8), dependent upon the angle of handgun section 14 relative to first should section 11. By employing magnetic connector 23 a user in the field can easily connect, adjust or remove second rod 21 from crank 30 and trigger lever 54 which contacts trigger 52 of handgun 50. A conventional eyehook 70 is affixed to handgun section 14 for maintaining second rod 21 relative thereto. Trigger lever 54 (best shown in FIG. 5) includes aperture 56 through which second rod 21 passes and is held therein by, preferably standard nut 57. A usual metal clip could also be used in place of nut 57 if needed. Trigger lever 54 is pivotably affixed to handgun section 14 by standard spring clip 58 (FIG. 4) which passes through a channel (not shown) in handgun section 14 and also through an aperture (not shown) in trigger lever 54. Trigger lever 54 is joined to and thus rotates on one leg of spring clip 58 as seen in FIG. 4. Coil spring 68 is affixed to handgun section 14 and trigger lever 54 to insure proper firing of handgun 50 so that upon release coil spring 68 will extend and retract to maintain trigger lever 54 in a ready position relative to trigger 52. During the mounting of handgun 50 trigger lever 54 is fitted inside the trigger guard of handgun 50 in front of handgun trigger 52.

The method of firing handgun 50 includes manually pulling stock trigger 16 as in normal firing causing stock trigger 16 to rotate, pulling first rod 22 to turn crank 30 in a counterclockwise direction as shown in FIGS. 5 and 8. The rotation of crank 30 urges second rod 21 towards crank 30 thereby urging trigger lever 54 rearwardly and applying pressure to handgun trigger 52, causing handgun 50 to fire. Crank 30 is shown as circular, but could have various shapes, such as an "X" or "T" shape, rectangle or otherwise as desired.

For additional stability and accuracy in firing shoulder stock 10, brace 60 as seen in FIGS. 1 and 2 is adjustably tightenable on first shoulder section 11 and hinge 59 of shoulder stock 10. Nuts 65, 65' as shown in FIGS. 2, 3 and 4 secure brace 60 to respectively hinge 59 and first shoulder section 11. Brace 60 includes brace handle 61 for gripping purposes during firing in addition to stock handle 27 as seen in FIGS. 1, 2, 3 and 4. Brace 60 further comprises slotted section 62 and elongated section 63 whereby brace handle 61 extends through slotted section 62 to engage elongated section 63 and can be loosened to extend brace 60 outwardly on either side of shoulder stock 10 in a somewhat V posture (not shown) or other desired angle and then tightened for use of shoulder stock 10.

During storage, shoulder stock 10 can be folded at hinge 13 and hinge 59 for compactness to shorten the overall length thereof. Rods 21 and 22 can easily be disengaged during folding and storage as required.

The illustrations and examples provided herein are for explanatory purposes and are not intended to limit the scope of the appended claims.

I claim:

1. A shoulder stock for a handgun comprising: a shoulder section, a handgun section, said handgun section pivotably joined to said shoulder section; a hinge, said hinge positioned between said handgun section and said shoulder section; a brace, said brace comprising an elongated section, a slotted section, and a handle, said elongated section having a first end and a second end, said first end connected to said shoulder section, and said second end directly connected to said slotted section and to said handle to couple said slotted section to said elongated section, said slotted section directly connected to said hinge; a trigger mechanism, said trigger mechanism connected to said shoulder section, said trigger mechanism comprising a magnetic connector, said magnetic connector attached to said handgun section.

2. The shoulder stock of claim 1 further comprising a locking pin assembly, said locking pin assembly comprising a pin, a sleeve, said pin contained within said sleeve, and said sleeve joined to said shoulder section.

3. The shoulder stock of claim 1 further comprising a revolvable mirror assembly, said revolvable mirror assembly affixed proximate said handgun section.

4. The shoulder stock of claim 3 wherein said revolvable mirror assembly comprises a mirror, said mirror revolvable from an upright position to a downward position.

5. The shoulder stock of claim 4 wherein said mirror assembly comprises an arm, said arm joined to said mirror.

6. The shoulder stock of claim 1 wherein said shoulder section comprises a first section and a second section, said first section pivotably joined to said second section, a stock latch, said stock latch affixed to said second section to maintain said second section in a desired position with said first section.

* * * * *